US010566721B2

(12) United States Patent
Nakajima et al.

(10) Patent No.: US 10,566,721 B2
(45) Date of Patent: Feb. 18, 2020

(54) CABLE CONNECTOR

(71) Applicant: KYOCERA Corporation, Kyoto-shi, Kyoto (JP)

(72) Inventors: Nobuyuki Nakajima, Tokyo (JP); Yoshiharu Fujii, Saitama (JP); Naoki Kitagawa, Yokohama (JP)

(73) Assignee: KYOCERA Corporation, Kyoto-shi, Kyoto (JP)

( * ) Notice: Subject to any disclaimer, the term of this patent is extended or adjusted under 35 U.S.C. 154(b) by 0 days.

(21) Appl. No.: 15/509,935

(22) PCT Filed: Jul. 16, 2015

(86) PCT No.: PCT/JP2015/070349
§ 371 (c)(1),
(2) Date: Mar. 9, 2017

(87) PCT Pub. No.: WO2016/047251
PCT Pub. Date: Mar. 31, 2016

(65) Prior Publication Data

US 2017/0331211 A1 Nov. 16, 2017

(30) Foreign Application Priority Data

Sep. 22, 2014 (JP) ..... 2014-192067

(51) Int. Cl.
*H01R 12/77* (2011.01)
*H01R 13/62* (2006.01)
(Continued)

(52) U.S. Cl.
CPC ..... *H01R 12/88* (2013.01); *H01R 12/79* (2013.01); *H01R 12/89* (2013.01); *H01R 12/592* (2013.01); *H01R 12/7011* (2013.01)

(58) Field of Classification Search
CPC ..... H01R 12/77; H01R 12/79; H01R 12/88; H01R 12/89; H01R 12/592;
(Continued)

(56) References Cited

U.S. PATENT DOCUMENTS 7,621,768 B2 11/2009 Suzuki et al.
7,789,681 B2 9/2010 Guan et al.
(Continued)

FOREIGN PATENT DOCUMENTS

CN 102651519 A 8/2012
JP 2004039479 A 2/2004
(Continued)

OTHER PUBLICATIONS

Espacenet. Patent Translate. Description. JP2009205914.*
(Continued)

*Primary Examiner* — Edwin A. Leon
*Assistant Examiner* — Milagros Jeancharles
(74) *Attorney, Agent, or Firm* — Kenja IP Law PC

(57) ABSTRACT

A cable connector includes: a contact (45A, 45B) supported by an insulator (20) having a cable insertion groove (21); a lock member (65) rotatable about a rotation shaft (74), between a lock position where a lock portion (68) of the lock member faces a locked portion (98) of a sheet-like cable (93) inserted in the insulator and an unlock position where the lock portion does not face the locked portion; and a bias portion (80) for biasing the lock member to the lock position, wherein an inner surface of the cable insertion groove includes a reference surface (21*a*) which is an end surface in a movement direction of the lock portion from the lock position to the unlock position, and a rotation center G of the rotation shaft is located on a side opposite to the movement direction, with respect to the reference surface.

4 Claims, 12 Drawing Sheets

(51) Int. Cl.

| | |
|---|---|
| ***H01R 12/88*** | (2011.01) |
| ***H01R 12/79*** | (2011.01) |
| ***H01R 12/89*** | (2011.01) |
| *H01R 12/59* | (2011.01) |
| *H01R 12/70* | (2011.01) |

(58) Field of Classification Search
CPC .... H01R 12/7011; H01R 13/05; H01R 13/15; H01R 13/627; H01R 24/28; H01R 13/62
USPC ..... 439/326–329, 352, 357, 493, 494, 499, 439/630
See application file for complete search history.

(56) References Cited

U.S. PATENT DOCUMENTS

| | | | | |
|---|---|---|---|---|
| 7,850,473 | B1 * | 12/2010 | Ozeki | H01R 23/661 439/260 |
| 7,878,843 | B2 * | 2/2011 | Zhang | H01R 12/7029 439/497 |
| 8,337,230 | B1 * | 12/2012 | Kurachi | H01R 12/79 439/328 |
| 8,608,509 | B2 | 12/2013 | Shimada et al. | |
| 8,845,358 | B2 * | 9/2014 | Kitagawa | H01R 13/627 439/357 |
| 9,960,534 | B2 * | 5/2018 | Nagae | H01R 12/774 |
| 10,181,661 | B2 * | 1/2019 | Manba | H01R 12/79 |
| 10,205,260 | B2 * | 2/2019 | Takemoto | H01R 12/79 |
| 2005/0032407 | A1 * | 2/2005 | Holzle | H01R 12/772 439/329 |
| 2009/0047836 | A1 | 2/2009 | Suzuki et al. | |
| 2011/0136365 | A1 * | 6/2011 | Hara | H01R 12/79 439/329 |
| 2012/0064749 | A1 * | 3/2012 | Hashimoto | H01R 12/774 439/329 |
| 2012/0077366 | A1 * | 3/2012 | Tsunemura | H01R 12/79 439/372 |
| 2012/0220171 | A1 * | 8/2012 | Shimada | H01R 12/774 439/660 |
| 2012/0238125 | A1 * | 9/2012 | Yoshisuji | H01R 12/592 439/350 |
| 2013/0005174 | A1 * | 1/2013 | Ishimaru | H01R 12/774 439/370 |
| 2014/0045383 | A1 * | 2/2014 | Fujii | H01R 12/79 439/630 |
| 2014/0099815 | A1 * | 4/2014 | Foster, Sr. | H01R 12/7029 439/327 |
| 2017/0331211 | A1 * | 11/2017 | Nakajima | H01R 12/88 |

FOREIGN PATENT DOCUMENTS

| | | | |
|---|---|---|---|
| JP | 2009205914 | A | 9/2009 |
| JP | 2010003616 | A | 1/2010 |
| JP | 2013054881 | A | 3/2013 |
| JP | 2013178892 | A | 9/2013 |
| JP | 2013254604 | A | 12/2013 |
| JP | 2016062851 | A | 4/2016 |
| WO | 2006126359 | A1 | 11/2006 |

OTHER PUBLICATIONS

Sep. 19, 2017, Notification of Reasons for Refusal issued by the Japan Patent Office in the corresponding Japanese Patent Application No. 2014-192067 with English language statement of relevance.

Oct. 6, 2015, International Search Report issued in the International Patent Application No. PCT/JP2015/070349.

* cited by examiner

CABLE CONNECTOR

TECHNICAL FIELD

The disclosure relates to a cable connector.

BACKGROUND

An FPC connector in JP 2009-205914 A (PTL 1) includes: an insulator having an FPC insertion groove into which an FPC having locked portions at both side edges is removably insertable; a plurality of contacts supported by the insulator in a state of being electrically connected to a circuit board; a lock member having a pair of lock claws that are detachably engageable with the respective pair of locked portions, and supported by the insulator so as to be rotatable between a lock position where the pair of lock claws face the respective locked portions in the FPC insertion/removal direction and an unlock position where the pair of lock claws do not face the respective locked portions in the FPC insertion/removal direction; and a pair of compression coil springs for biasing the lock member to rotate to the lock position.

When the end of the FPC is inserted into the insulator, the end of the FPC presses the lock claws, as a result of which the lock member located at the lock position rotates to the unlock position. When the lock claws no longer face the locked portions, the lock member automatically rotates to the lock position by the bias force of the compression coil springs, to be in a state (lock state) where the lock claws are engageable with the locked portions.

Thus, the FPC connector in PTL 1 can connect the FPC and the contacts by one operation of inserting the FPC into the insulator.

Moreover, by manually rotating the lock member to the unlock position and then applying, to the FPC, a force in the direction of escaping from the insulator, the FPC can be smoothly removed from the insulator.

CITATION LIST

Patent Literatures

PTL 1: JP 2009-205914 A

SUMMARY

Technical Problem

The FPC connector in PTL 1 biases the lock member to rotate to the lock position using the bias force of the compression coil springs. Accordingly, if the bias force of the compression coil springs is reduced (to facilitate deformation), the FPC can be connected to the connector with a small insertion force.

However, if the bias force of the compression coil springs is reduced, the lock member located at the lock position tends to move to the unlock position with a small force.

In the FPC connector in PTL 1, the rotation center of the lock member is located more toward the rotation direction of the lock member to the unlock position (the movement direction of the lock member from the lock position to the unlock position) than the FPC insertion groove. Accordingly, when an external force in the direction of escaping from the insulator is exerted on the FPC in a state where the lock member is located at the lock position (without manually rotating the lock member to the unlock position) and the locked portions engage with the lock claws, a rotational moment of a certain magnitude to rotate to the unlock position acts on the lock member.

Therefore, if an unintentional external force is exerted on the FPC in a state where the lock member is located at the lock position, there is a possibility that the FPC is unintentionally removed from the insulator (despite not manually rotating the lock member to the unlock position).

It could therefore be helpful to provide a cable connector that effectively eliminates the possibility of the cable being unintentionally removed from the insulator even in the case where the lock member for maintaining the cable connection state is biased to rotate in the lock direction with a small bias force.

Solution to Problem

A cable connector according to the disclosure includes: an insulator having a cable insertion groove into which a sheet-like cable having a locked portion is removably insertable; a contact supported by the insulator and coming into contact with the cable inserted in the insulator; a lock member rotatable about a rotation shaft thereof supported by the insulator, between a lock position where a lock portion of the lock member faces the locked portion inserted in the insulator from an escape direction of the cable from the insulator and an unlock position where the lock portion does not face the locked portion from the escape direction; and a bias portion for biasing the lock member to the lock position, and allowing the lock member to rotate to the unlock position by elastic deformation, wherein an inner surface of the cable insertion groove includes a reference surface which is an end surface in a movement direction of the lock portion from the lock position to the unlock position, and a rotation center of the rotation shaft is located on a side opposite to the movement direction, with respect to the reference surface.

The rotation center of the rotation shaft may be located on the side opposite to the movement direction of the lock portion from the lock position to the unlock position, with respect to a contact portion of the lock portion located at the lock position with the locked portion.

The cable may include a lock portion insertion portion which is a recess or through hole that passes through the cable in a thickness direction and is adjacent to the locked portion, and the lock portion may be a lock claw that, when the lock member is located at the lock position, enters the lock portion insertion portion and faces the locked portion from the escape direction.

The contact may include: a fixed piece attached to the insulator in a fixed state; an elastic deformation piece coming into contact with the cable inserted in the insulator, and elastically deformable in a thickness direction of the cable; and a connection portion connecting a base end of the elastic deformation piece and the fixed piece, and enabling the elastic deformation piece to swing in the thickness direction about the base end relative to the fixed piece.

Advantageous Effect

In the cable connector according to the disclosure, the rotation center of the rotation shaft is located on the side opposite to the movement direction of the lock portion from the lock position to the unlock position, with respect to the reference surface of the cable insertion groove.

Hence, in the case where an external force in the direction of escaping from the insulator is exerted on the cable in a state where the lock member is located at the lock position (without manually rotating the lock member to the unlock position) and the locked portion engages with the lock portion, a rotational moment of rotating to the side opposite to the unlock position tends to act on the lock member. Here, in the case where the contact portion of the lock portion with the locked portion and the rotation center of the rotation shaft are located at the same position in the cable thickness direction, no rotational moment tends to act on the lock member. In the case where the rotation center is located more toward the aforementioned movement direction than the contact portion, the distance between the rotation center and the contact portion in the thickness direction is very small, and so the rotational moment acting on the lock member to rotate to the unlock position is very small.

This effectively eliminates the possibility of the cable being unintentionally removed from the insulator even in the case where the lock member is biased to rotate in the lock direction with a small bias force.

DETAILED DESCRIPTION

Figure 1:
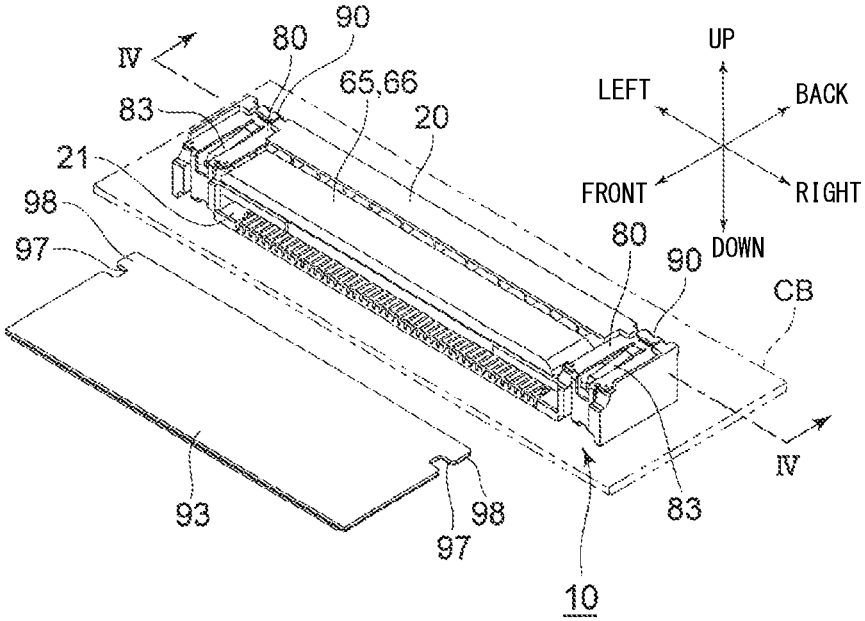
FIG. 1 is a perspective view of an FPC connector used as right angle type according to one of the disclosed embodiments and an FPC in a separated state, as seen obliquely from front above.

The following describes one of the disclosed embodiments with reference to attached drawings. The directions such as front, back, right, left, up, and down in the following description are based on the arrow directions in the drawings.

An FPC connector 10 in this embodiment is used as right angle (RA) type where a cable (FPC 93) is inserted in parallel to a circuit board CB (see FIGS. 1, 8, 18, 23, etc.) on which the connector is mounted. For example, the FPC connector 10 can be mounted on the circuit board CB installed inside office automation equipment (e.g. a copier, a combined machine having copy and fax functions) in a fixed state. The FPC connector 10 includes an insulator 20, signal contacts 45A and 45B (contacts), ground contacts 55, a lock member 65, and lock member bias springs 80 (bias portion), as main components.

Figure 10:
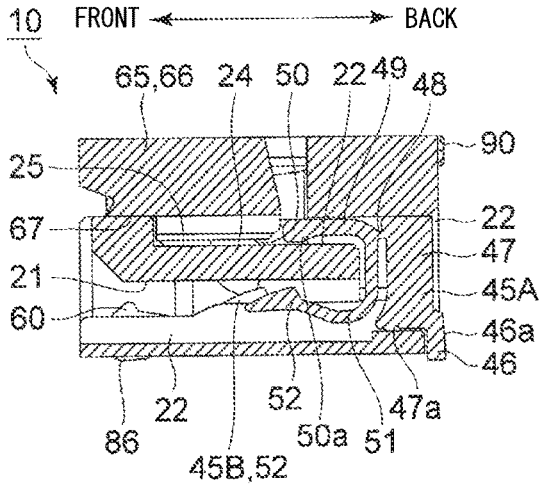
FIG. 10 is a sectional view along arrow X-X in FIG. 7.
Figure 11:
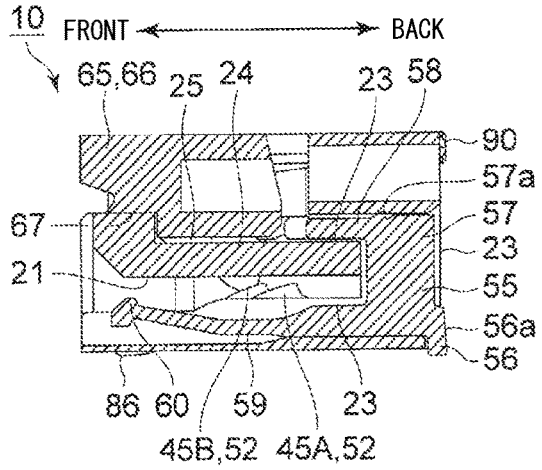
FIG. 11 is a sectional view along arrow XI-XI in FIG. 7.
Figure 12:
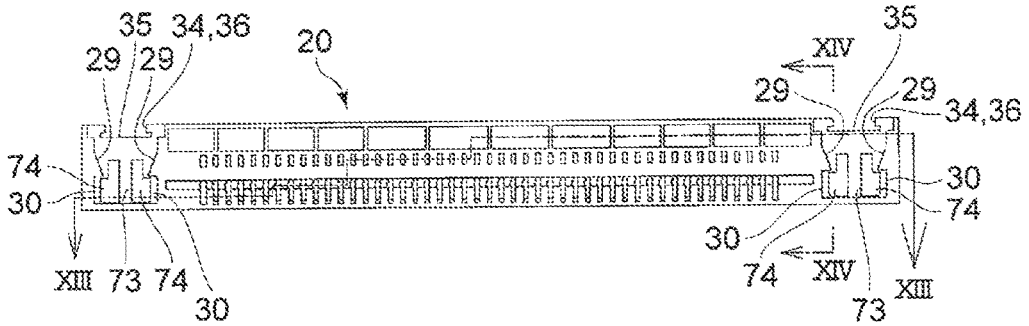
FIG. 12 is a sectional view of the insulator along arrow IV-IV in FIG. 1.
Figure 13:
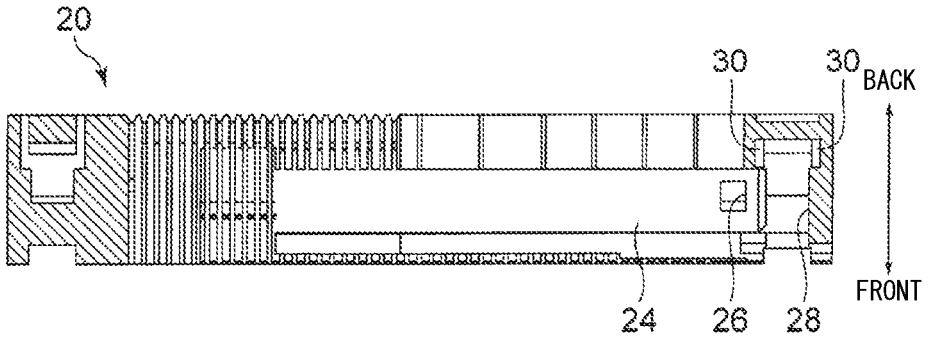
FIG. 13 is a sectional view along arrow XIII-XIII in FIG. 12.
Figure 14:
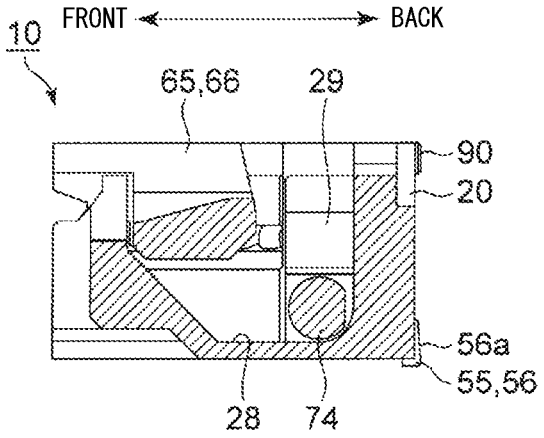
FIG. 14 is a sectional view along arrow XIV-XIV in FIG. 12.
Figure 15:
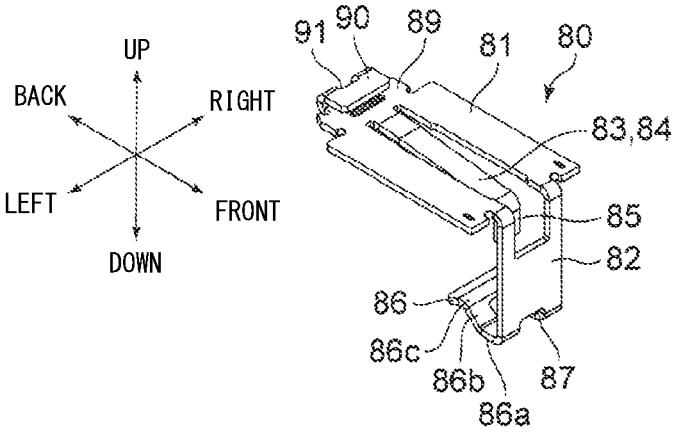
FIG. 15 is a perspective view of a lock member bias spring as seen from front.
Figure 16:
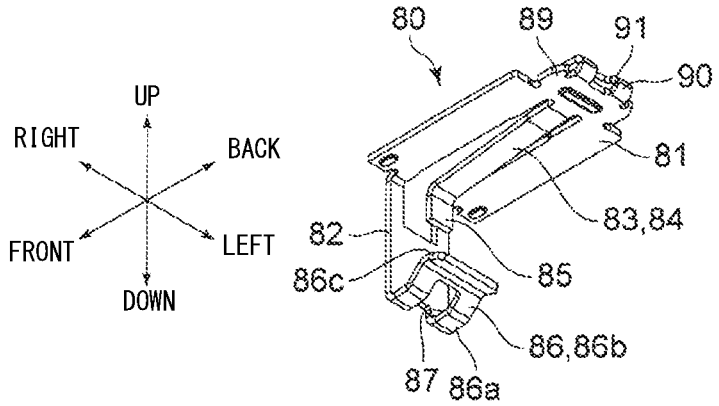
FIG. 16 is a perspective view of the lock member bias spring as seen from back.
Figure 17:
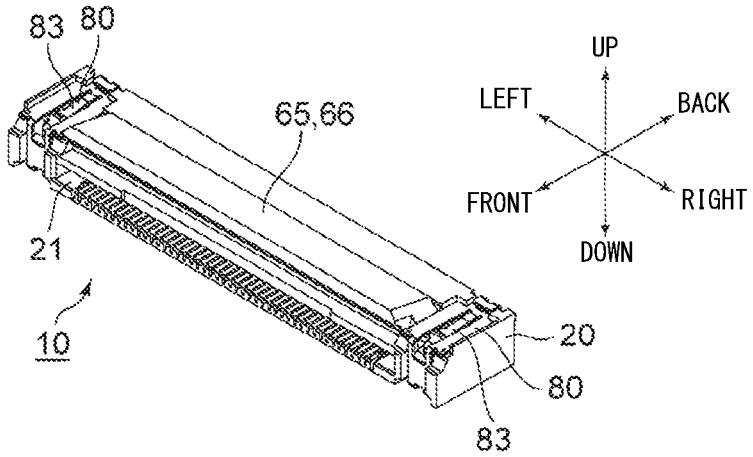
FIG. 17 is a perspective view of the FPC connector when the lock member is located at the unlock position, as seen obliquely from front above.
Figure 18:
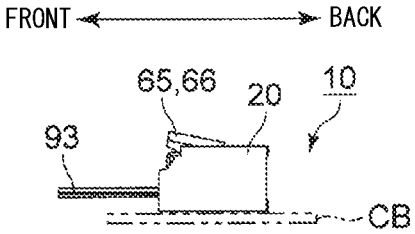
FIG. 18 is a side view of the FPC inserted in the insulator and the FPC connector with the lock member located at the unlock position.
Figure 19:
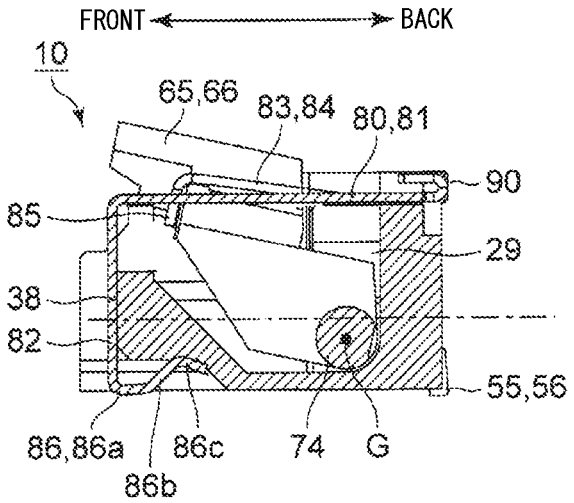
FIG. 19 is the same sectional view as in FIG. 8 when the lock member is located at the unlock position.

The bilaterally symmetric insulator 20 is formed by injection molding an insulating and heat-resistant synthetic resin material. As illustrated, an FPC insertion groove 21 (cable insertion groove) extending backward is formed in the front part of the insulator 20 other than the right and left sides. The insulator 20 has signal contact insertion grooves 22 and ground contact insertion grooves 23 passing through the insulator 20 in the front-back direction. A total of 46 signal contact insertion grooves 22 each have its back end open at the back surface of the insulator 20, and its front part (the part other than the back end) bifurcated in the up-down direction (separated into upper and lower parts by the below-mentioned front ceiling wall 24 as illustrated in FIG. 10, etc.). The front lower signal contact insertion groove 22 is formed in the bottom surface of the FPC insertion groove 21. A pair of right and left ground contact insertion grooves 23 on the right and left sides of the signal contact insertion grooves 22 each have its back end open at the back surface of the insulator 20, and its front part (the part other than the back end) bifurcated in the up-down direction (separated into upper and lower parts by the below-mentioned front ceiling wall 24 as illustrated in FIG. 11, etc.). The front lower ground contact insertion groove 23 is formed in the bottom surface of the FPC insertion groove 21.

Figure 9:
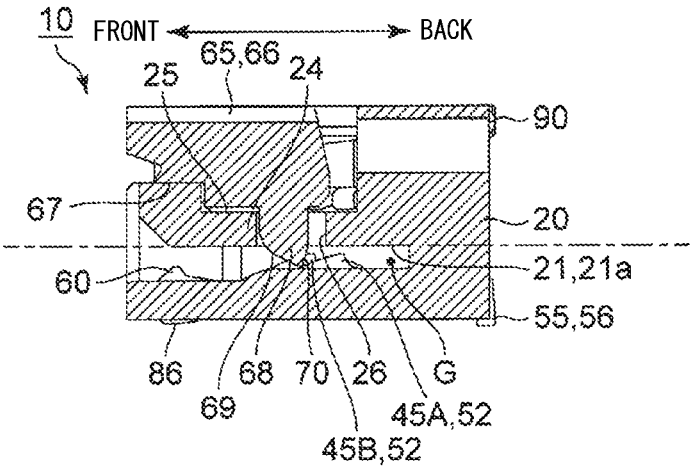
FIG. 9 is a sectional view along arrow IX-IX in FIG. 7.
Figure 20:
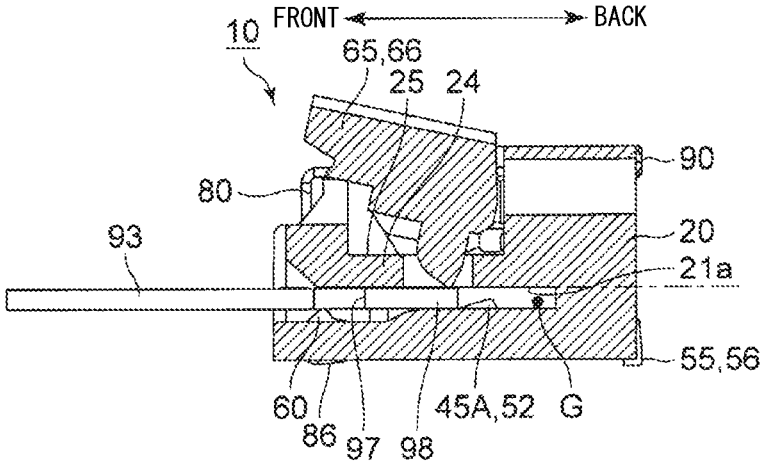
FIG. 20 is the same sectional view as in FIG. 9 when the lock member is located at the unlock position.
Figure 25:
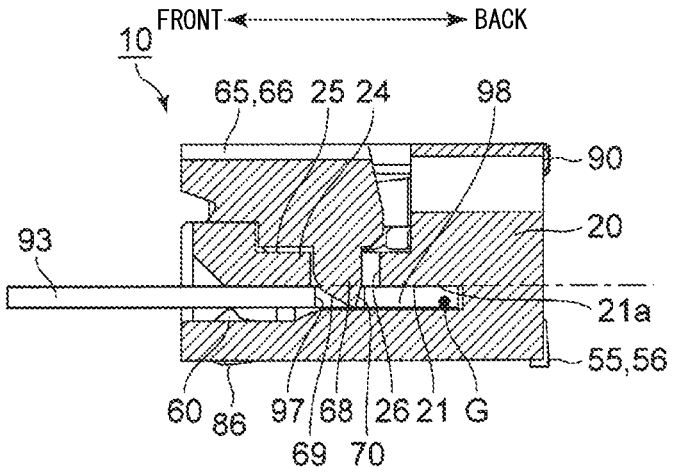
FIG. 25 is the same sectional view as in FIG. 9 when the lock member is returned to the lock position.
Figure 26:
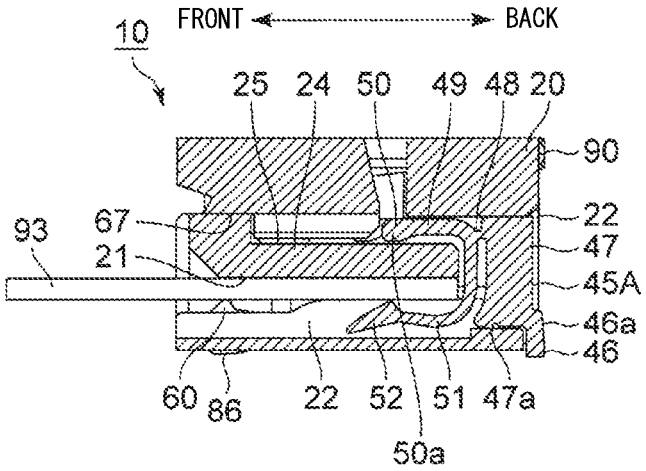
FIG. 26 is the same sectional view as in FIG. 10 when the lock member is returned to the lock position.
Figure 27:
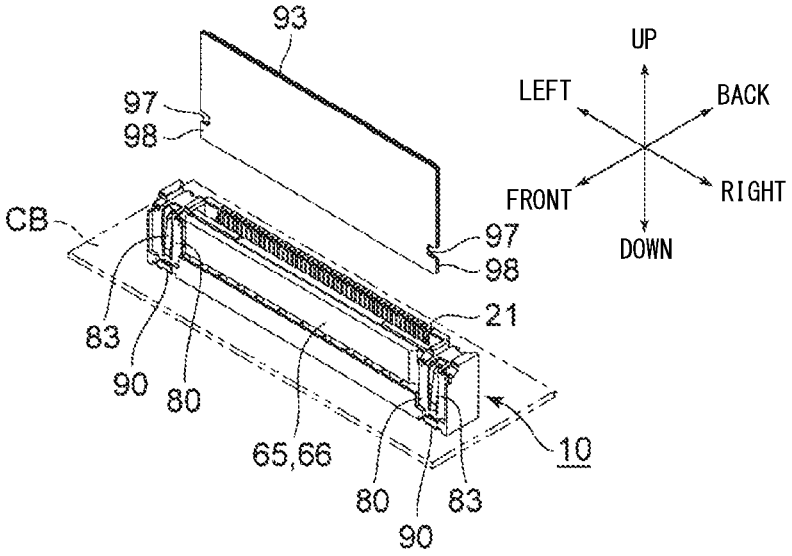
FIG. 27 is a perspective view of the FPC connector used as straight type and the FPC in a separated state.

The front ceiling wall 24 extending substantially horizontally from the front end to the vicinity of the back end of the insulator 20 is provided in the upper part of the insulator 20 other than the right and left sides. An operation portion receiving recess 25 one level lower than the back part of the insulator 20 is formed in the upper surface of the front ceiling wall 24. A lock claw receiving hole 26 that passes through the front ceiling wall 24 in the up-down direction and has its lower end communicating with the FPC insertion groove 21 is formed near each of the right and left ends of the upper surface of the front ceiling wall 24 (the bottom surface of the operation portion receiving recess 25) (see FIGS. 9, 20, 25, etc.).

A supported portion receiving recess 28 that is depressed downward is formed in the upper surface of each of the right and left ends of the insulator 20. The back part of the supported portion receiving recess 28 has a cross-sectional shape illustrated in FIG. 4, etc. In detail, the right and left inner surfaces of the back part of the supported portion receiving recess 28 include a pair of inclined guide surfaces 29 inclined to approach each other in the downward direction. The lower end of the inner surface of the back part of the supported portion receiving recess 28 forms a rotation shaft support recess 30 depressed laterally and backward from the lower end of each inclined guide surface 29.

Figure 4:
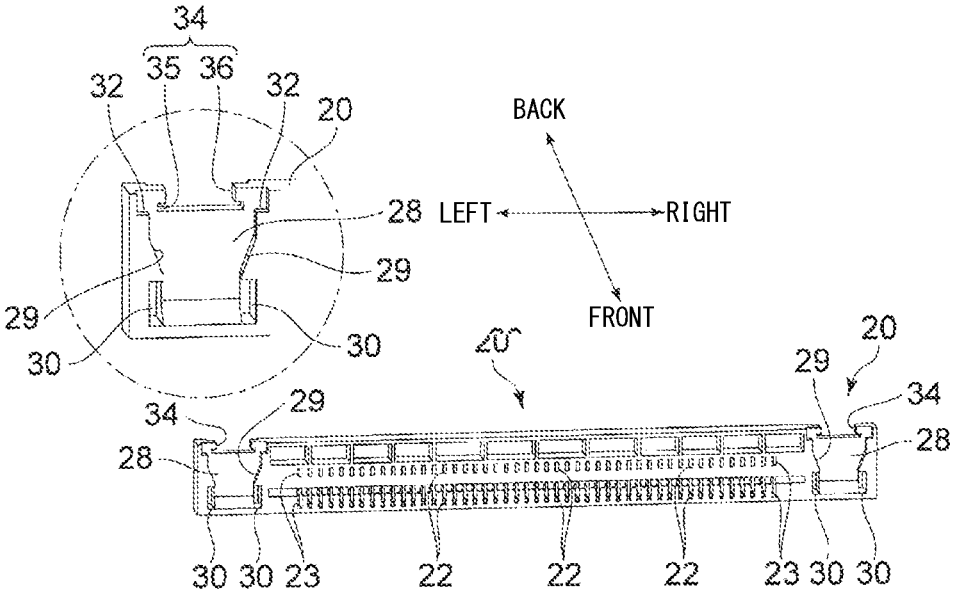
FIG. 4 is a perspective view of an insulator as seen from front, illustrating a section along arrow IV-IV in FIG. 1.
Figure 5:
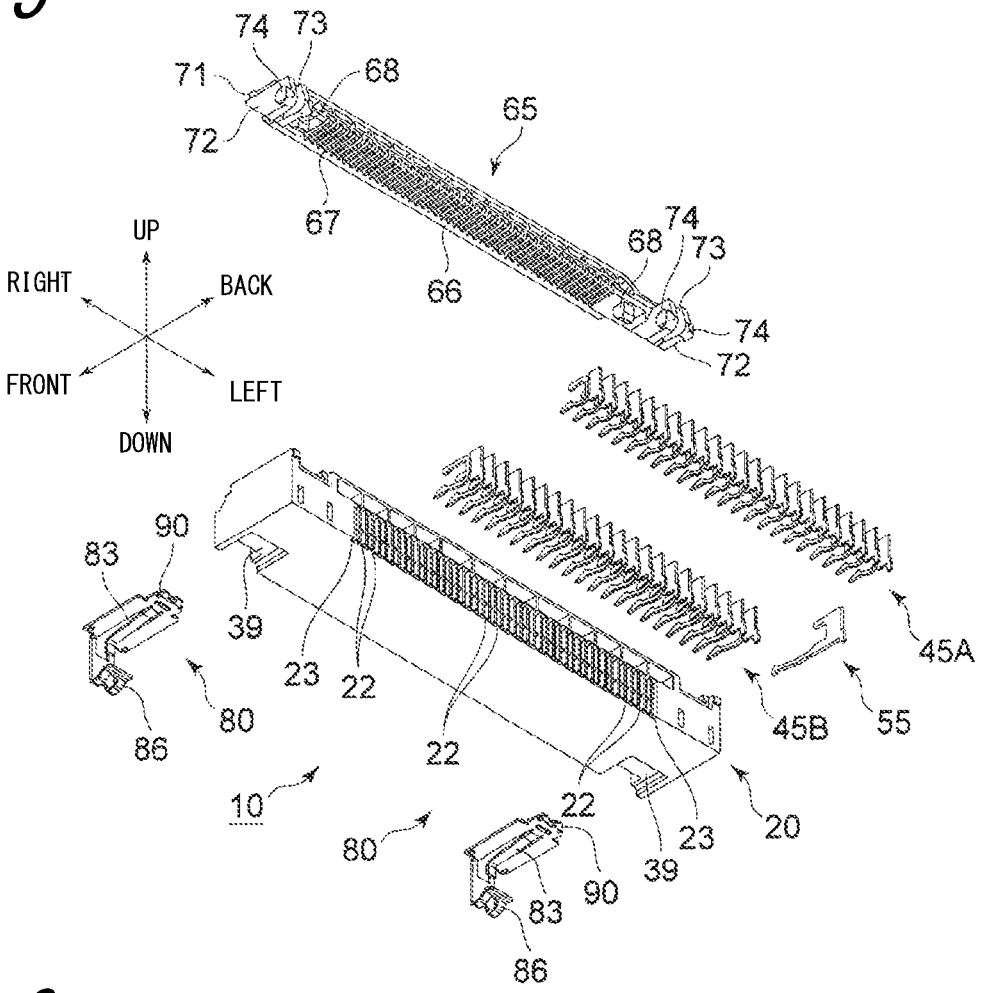
FIG. 5 is an exploded perspective view of the FPC connector as seen obliquely from back below.
Figure 6:
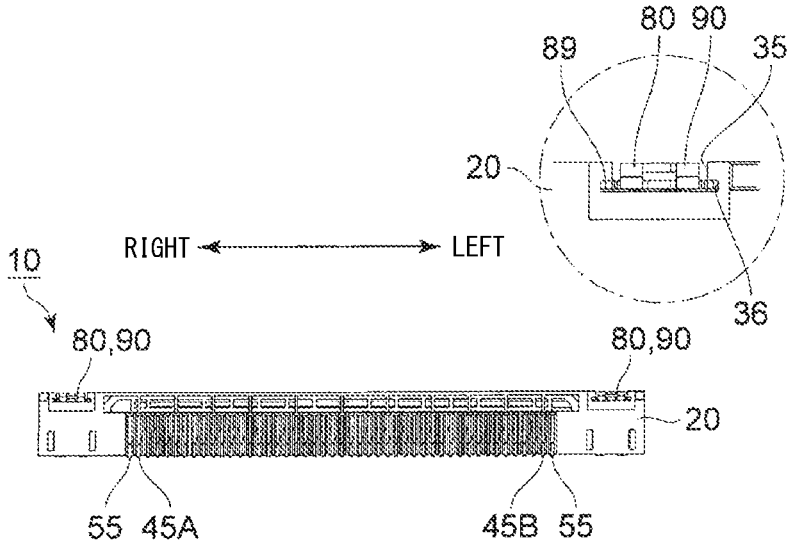
FIG. 6 is a back view of the connector and an enlarged view of a side part of the back of the connector.
Figure 7:
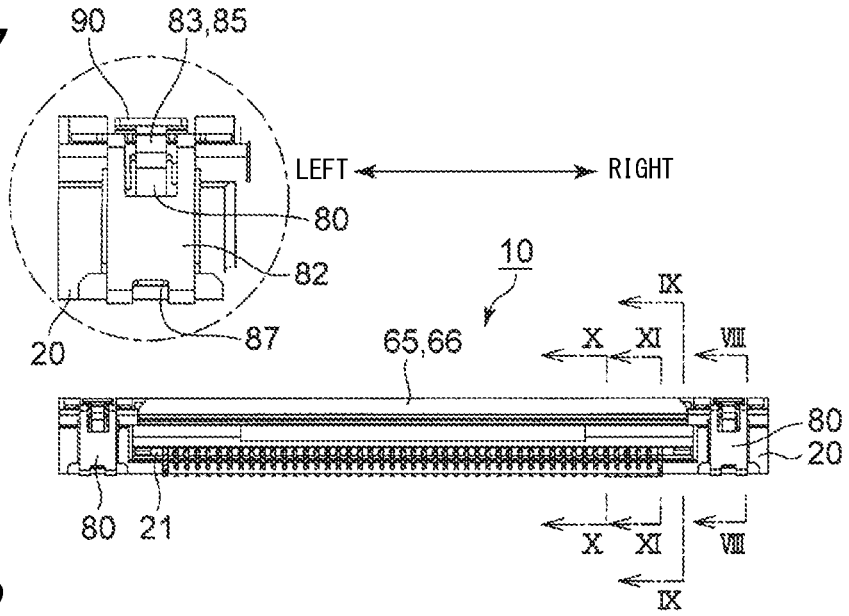
FIG. 7 is a front view of the connector and an enlarged view of a side part of the front of the connector.

A base portion support surface 32 made up of three surfaces separate from each other is formed in the upper part of each of the right and left ends of the insulator 20. A second tail support groove 34 is formed at each of the right and left ends of the insulator 20. As illustrated in FIG. 4, the second tail support groove 34 is a groove passing through the back wall of the insulator 20 in the front-back direction, and includes: a stopper groove 35 constituting the lower part of the second tail support groove 34; and a passage allowance groove 36 constituting the upper part of the second tail support groove 34 and having a shorter right-left width than the stopper groove 35.

An orthogonal portion support groove 38 located directly in front of the supported portion receiving recess 28 is formed in the front surface of each of the right and left ends of the insulator 20. A first tail support groove 39 continuous with the lower end of the orthogonal portion support groove 38 and extending backward is formed in the lower surface of each of the right and left ends of the insulator 20.

23 signal contacts 45A and 23 signal contacts 45B are formed by molding a sheet of a copper alloy (e.g. phosphor bronze, beryllium copper, titanium copper) or a corson copper alloy having spring elasticity by progressive dies (stamping) in the illustrated shape. The surfaces of the signal contacts 45A and 45B are nickel plated to form a base and then gold plated, and each of the signal contacts 45A and 45B has conductivity. As illustrated, each of the signal contacts 45A and 45B includes: a tail piece 46 extending in the up-down direction; a fixed piece 47 extending upward from the upper end of the tail piece 46; a connection portion 48 extending frontward from the vicinity of the upper end of the fixed piece 47; and a sandwiching portion 49 substantially U-shaped in a side view and extending frontward from the front end of the connection portion 48. As illustrated in FIG. 10, etc., the back end surface of the tail piece 46 is formed by an inclined end surface 46*a* inclined relative to the up-down direction. The sandwiching portion 49 includes: a stabilizer 50 constituting the upper part of the sandwiching portion 49 and extending frontward substantially linearly; and an elastic deformation piece 51 extending downward from the front end of the connection portion 48 and then extending frontward. An upward contact projection 52 is formed at the front end of the elastic deformation piece 51. A downward abutting projection 50*a* is formed at the end of the stabilizer 50. As illustrated in FIGS. 3, 5, 10, 11, etc., the signal contacts 45A and 45B are the same in the shape of each of the tail piece 46, fixed piece 47, and connection portion 48, but different in the shape of the sandwiching portion 49. In detail, the front-back length of each of the stabilizer 50 and elastic deformation piece 51 is longer in the signal contact 45B than the signal contact 45A.

The signal contacts 45A and 45B are inserted in the respective signal contact insertion grooves 22 of the insulator 20 from their back end openings, in a state where the signal contacts 45A and 45B are arranged alternately in the right-left direction. The fixed piece 47 of each of the signal contacts 45A and 45B is pressed in the back of the signal contact insertion groove 22. Since a locking projection 47*a* formed in the lower surface of the fixed piece 47 digs into the inner surface of the insulator 20, the fixed piece 47 is fixed to the back of the signal contact insertion groove 22. As illustrated in FIG. 10, etc., the back end (inclined end surface 46*a*) of the tail piece 46 slightly projects backward from the back end surface of the insulator 20, and the lower end of the tail piece 46 slightly projects downward from the lower surface of the insulator 20. The stabilizer 50 of each of the signal contacts 45A and 45B is inserted in the upper signal contact insertion groove 22, with its lower surface (abutting projection 50*a*) being slightly separate from the upper surface of the front ceiling wall 24. The elastic deformation piece 51 of each of the signal contacts 45A and 45B is inserted in the lower signal contact insertion groove 22 (the signal contact insertion groove 22 formed in the bottom surface of the FPC insertion groove 21). The elastic deformation piece 51 of each of the signal contacts 45A and 45B is elastically deformable in the up-down direction in the corresponding lower signal contact insertion groove 22, and the contact projection 52 projects into the FPC insertion groove 21 when the elastic deformation piece 51 is in a free state (see FIG. 10, etc.).

A pair of ground contacts 55 made of metal having spring elasticity each include: a tail piece 56 extending in the up-down direction; a fixed piece 57 extending upward from the upper end of the tail piece 56; a stabilizer 58 extending frontward from the upper end of the fixed piece 57 substantially linearly; and an elastic deformation piece 59 extending frontward from the lower end of the fixed piece 57. An upward contact projection 60 is formed at the front end of the elastic deformation piece 59. As illustrated in FIG. 11, etc., the back end surface of the tail piece 56 is formed by an inclined end surface 56*a* inclined relative to the up-down direction.

The pair of ground contacts 55 are inserted in the respective ground contact insertion grooves 23 of the insulator 20 from their back end openings. The fixed piece 57 of each ground contact 55 is pressed in the back of the ground contact insertion groove 23. Since a locking projection 57*a* formed in the upper surface of the fixed piece 57 digs into the inner surface of the insulator 20, the fixed piece 57 is fixed to the back of the ground contact insertion groove 23. As illustrated in FIG. 11, etc., the back end (inclined end surface 56*a*) of the tail piece 56 slightly projects backward from the back end surface of the insulator 20, and the lower end of the tail piece 56 slightly projects downward from the lower surface of the insulator 20. The stabilizer 58 of each ground contact 55 is inserted in the upper ground contact insertion groove 23, with its lower surface being slightly separate from the upper surface of the front ceiling wall 24. The elastic deformation piece 59 of each ground contact 55 is inserted in the lower ground contact insertion groove 23 (the ground contact insertion groove 23 formed in the bottom surface of the FPC insertion groove 21). The elastic deformation piece 59 of each ground contact 55 is elastically deformable in the up-down direction in the corresponding lower ground contact insertion groove 23, and the contact projection 60 projects into the ground contact insertion groove 23 when the elastic deformation piece 59 is in a free state (see FIG. 11, etc.). The contact projection 60 is located more frontward than the contact projection 52 of each of the signal contacts 45A and 45B (see FIGS. 9 to 11, etc.).

The lock member 65 is bilaterally symmetric object formed by injection molding (integral molding) a heat-resistant synthetic resin material.

The lock member 65 includes an operation portion 66 extending in the right-left direction. A lock position regulation surface 67 which is a plane is formed in the lower surface of the operation portion 66. Moreover, a pair of right and left lock claws 68 (lock portions) project from the lower surface of the operation portion 66. A pressed surface 69 and a lock surface 70 both inclined relative to the up-down direction when the lock member 65 is located at the below-mentioned lock position are formed in the front and back surfaces of each lock claw 68.

A spring receiving projection 71 is formed in the upper surface of each of the right and left sides of the lock member 65. The lower part of each of the right and left sides of the lock member 65 is formed by a supported portion 72. A slit 73 whose front and back surfaces are open is formed in the lower surface of the supported portion 72. The supported portion 72 is therefore elastically deformable in the direction in which its right-left width decreases. Substantially cylindrical rotation shafts 74 extending in the right-left direction coaxially with each other project from the right and left side surfaces of each of the right and left supported portions 72.

The lock member 65 is attached to the insulator 20 by inserting the right and left supported portions 72 into the right and left supported portion receiving recesses 28 from above the insulator 20. When each supported portion 72 is in a free state, the right-left distance between the left end surface of the left rotation shaft 74 and the right end surface of the right rotation shaft 74 projected from the supported portion 72 is less than the right-left distance between the upper ends of the right and left inclined guide surfaces 29 of the supported portion receiving recess 28 but greater than the right-left distance between the lower ends of the right and left inclined guide surfaces 29. Accordingly, when the right and left supported portions 72 are inserted into the right and left supported portion receiving recesses 28 from above the insulator 20, the right and left rotation shafts 74 come into contact with the right and left inclined guide surfaces 29 of the supported portion receiving recess 28. When the lock member 65 is further pushed downward from this state, however, the right and left supported portions 72 each elastically deform in the direction in which its right-left width decreases while using the slit 73, so that the right-left distance between the left end surface of the left rotation shaft 74 and the right end surface of the right rotation shaft 74 projected from the supported portion 72 becomes less than the right-left distance between the lower ends of the right and left inclined guide surfaces 29. The right and left rotation shafts 74 projected from the supported portion 72 therefore move below the right and left inclined guide surfaces 29 while climbing over the inclined guide surfaces 29 downward. As a result, the right and left supported portions 72 return to a free state, and so the right and left rotation shafts 74 of each supported portion 72 freely fit into a corresponding one of the right and left rotation shaft support recesses 30, and the rotation center G of each rotation shaft 74 is located below a ceiling surface 21*a* (a reference surface, the position of the long dashed short dashed line in each of FIGS. 9, 19, 20, 24, and 25 indicates the same height as the ceiling surface 21*a*) of the FPC insertion groove 21. When the right and left supported portions 72 each climb over the inclined guide surfaces 29 and return to a free state, the worker who attaches the lock member 65 to the insulator 20 can feel clicking. Here, since the right-left distance between the left end surface of the left rotation shaft 74 and the right end surface of the right rotation shaft 74 becomes greater than the right-left distance between the lower ends of the right and left inclined guide surfaces 29 again, upward escape of each rotation shaft 74 from the rotation shaft support recess 30 is regulated. Moreover, the lock member 65 (right and left supported portions 72) becomes rotatable relative to the insulator 20 (rotation shaft support recesses 30) about the rotation center G (FIGS. 8, 9, 19, 20, 24, 25) of each rotation shaft 74. In detail, the lock member 65 is rotatable between the lock position illustrated in FIGS. 1, 2, 6 to 11, and 22 to 26 and the unlock position illustrated in FIGS. 17 to 21. When the lock member 65 is located at the lock position, the operation portion 66 of the lock member 65 is located in the operation portion receiving recess 25 of the insulator 20, and the lock position regulation surface 67 of the operation portion 66 is in surface contact with the upper end surface of the front part of the insulator 20. Further downward rotation of the lock member 65 is thus regulated. Furthermore, each lock claw 68 enters into the FPC insertion groove 21 via the corresponding lock claw receiving hole 26 (see FIGS. 9 and 25). When the lock member 65 is located at the unlock position, on the other hand, the lock position regulation surface 67 of the operation portion 66 separates upward from the upper end surface of the front part of the insulator 20, and most of the right and left lock claws 68 withdraws upward from the FPC insertion groove 21.

A pair of right and left lock member bias springs 80 having elasticity are molded from a metal (copper alloy or stainless steel) plate material, and are each a substantially L-shaped member including: a flat base portion 81; and an orthogonal portion 82 extending downward from the front end of the base portion 81 and having a smaller right-left width than the base portion 81. A cut and raised piece 83 is formed at the center of the base portion 81 and orthogonal portion 82 in the width direction. The cut and raised piece 83 includes: a lock member press portion 84 inclined relative to the base portion 81 in a free state; and a tip orthogonal portion 85 projecting from the tip of the lock member press portion 84 and substantially orthogonal to the lock member press portion 84. A first tail 86 extends obliquely back upward from the lower end of the orthogonal portion 82. The first tail 86 includes: a bottom portion 86*a* extending substantially backward from the lower end of the orthogonal portion 82; an inclined portion 86*b* extending from the back end of the bottom portion 86*a* while inclining relative to the bottom portion 86*a*; and an engaging projection 86*c* connected to the tip of the inclined portion 86*b*. A solder slit 87 is formed across the lower end of the orthogonal portion 82 and the first tail 86. A fitting portion 89 having a smaller right-left width than the base portion 81 projects backward from the back end of the base portion 81. A second tail 90 extending upward from the back end and then extending frontward and having the same right-left width as the fitting portion 89 projects from the back end of the fitting portion 89. A solder slit 91 is formed at the back end of the second tail 90.

The right and left lock member bias springs 80 are attached to the insulator 20, after attaching the lock member 65 to the insulator 20. In detail, in a state where the lock member 65 is located at the lock position, the lower surface of the base portion 81 is caused to abut on the base portion support surface 32 of the insulator 20, and the back surface of the orthogonal portion 82 is caused to abut on the bottom surface (back surface) of the orthogonal portion support groove 38. Moreover, while slightly projecting the back end of the second tail 90 backward from the back end surface of the insulator 20 (see FIGS. 8, 10, etc.), the part of the second tail 90 other than the back end is located in the passage allowance groove 36, and the fitting portion 89 is fitted into the stopper groove 35 (see FIG. 6). Furthermore, the engaging projection 86*c* of the first tail 86 is engaged with the first tail support groove 39 from below, and the bottom portion 86*a* of the first tail 86 is slightly projected downward from the lower end surface of the insulator 20 (see FIG. 8, etc.). As a result, the tip of the lock member press portion 84 in a free state abuts on the spring receiving projection 71 of the lock member 65 from above, and biases the lock member 65 to rotate to the lock position. This suppresses rattling or unintentional release of the lock member 65 located at the lock position. The tip orthogonal portion 85 is located directly in front of the front surface of the spring receiving projection 71.

The FPC connector 10 having the aforementioned structure can be mounted on the upper surface of the circuit board CB having a rectangular planar shape, by soldering the tail piece 46 of each of the signal contacts 45A and 45B to a circuit pattern formed on the upper surface of the circuit board CB and soldering the tail piece 56 of each ground contact 55 and the first tail 86 of each lock member bias spring 80 to a ground pattern on the circuit board CB.

Figure 8:
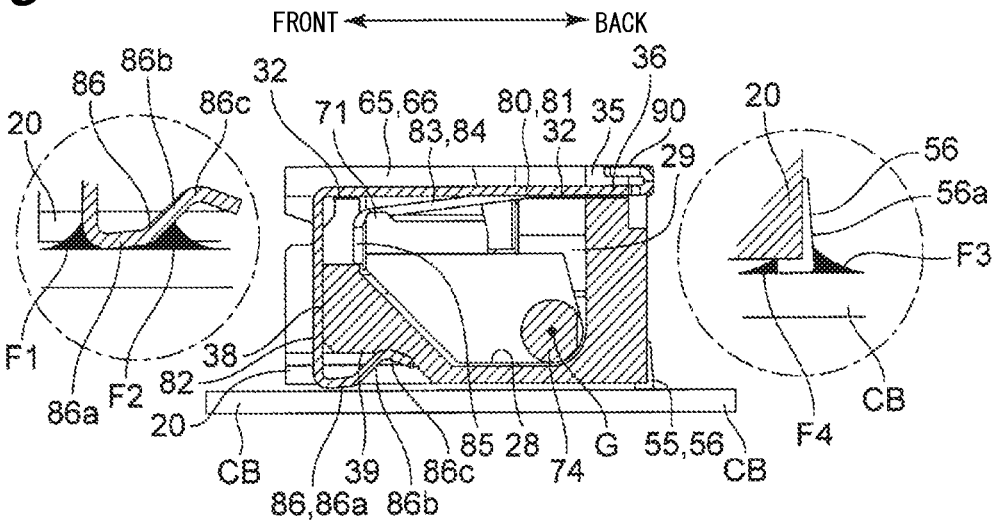
FIG. 8 is a sectional view along arrow VIII-VIII in FIG. 7.

As illustrated in FIG. 8, it is preferable to form a solder fillet F1 between the front end of the first tail 86 and the ground pattern and, while filling the solder slit 87 with solder, form a solder fillet F2 between the bottom portion 86*a* inclined relative to the circuit board CB and the ground pattern of the circuit board CB and between the inclined portion 86*b* and the ground pattern of the circuit board CB. It is also preferable to form a solder fillet F3 between the inclined end surface 56*a* of the tail piece 56 of the ground contact 55 and the ground pattern, and form a solder fillet F4 between the front surface of the tail piece 56 and the ground pattern. The tail piece 46 of each of the signal contacts 45A and 45B is preferably soldered to the circuit pattern of the circuit board CB in the same mode as the tail piece 56.

The following describes how the FPC 93 (flexible printed circuit board, only one end and its vicinity being illustrated in FIGS. 1, 2, 20, 21 to 26, etc.) which is a long sheet-like cable is connected to and disconnected from the FPC connector 10 and the operation of the FPC connector 10 at the connection and disconnection.

As illustrated, the FPC 93 has a stack structure formed by bonding a plurality of thin film materials to each other, and includes: 46 circuit patterns 94 linearly extending along the extending direction of the FPC 93; an insulating cover layer 95 covering both surfaces of the part of the circuit patterns 94 other than both ends; and an end reinforcement member 96 constituting both ends of the FPC 93 in the longitudinal direction, having one surface (lower surface in the drawings) integrated with both ends of the circuit patterns 94, and harder than other parts. An engaging recess 97 (lock portion insertion portion) is formed at each of both side edges of the end reinforcement member 96, and the end of the end reinforcement member 96 located directly behind the engaging recess 97 forms a locked portion 98. The entire lower surface of the end reinforcement member 96 serves as a ground terminal 99. The thickness of the FPC 93 is greater than the up-down gap dimension between the contact projection 52 of the elastic deformation piece 51 (signal contact 45A, 45B) in a free state and the ceiling surface 21*a* of the FPC insertion groove 21. Thus, the FPC connector is a Non-ZIF (Zero Insertion Force) type connector.

Figure 2:
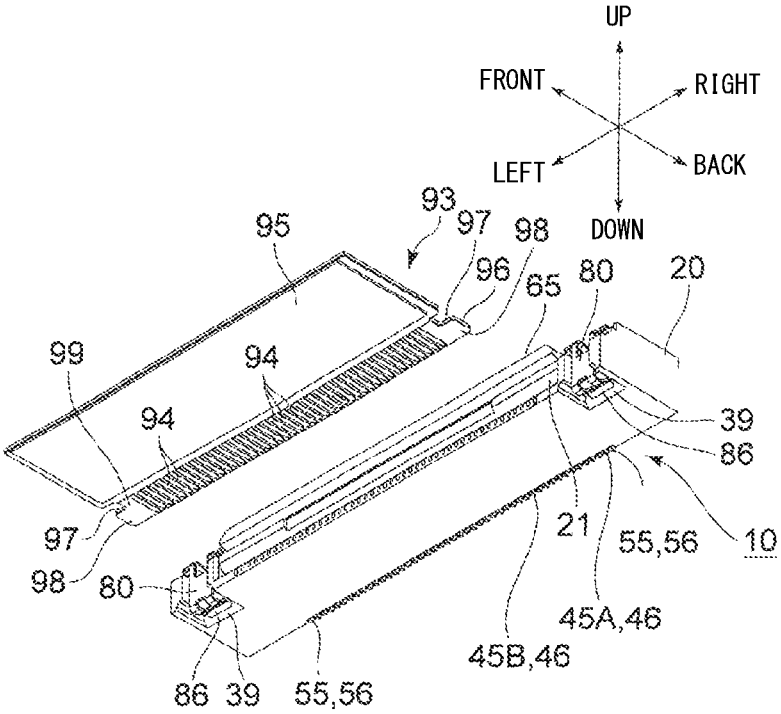
FIG. 2 is a perspective view of the FPC connector and the FPC in a separated state, as seen obliquely from front below.
Figure 3:
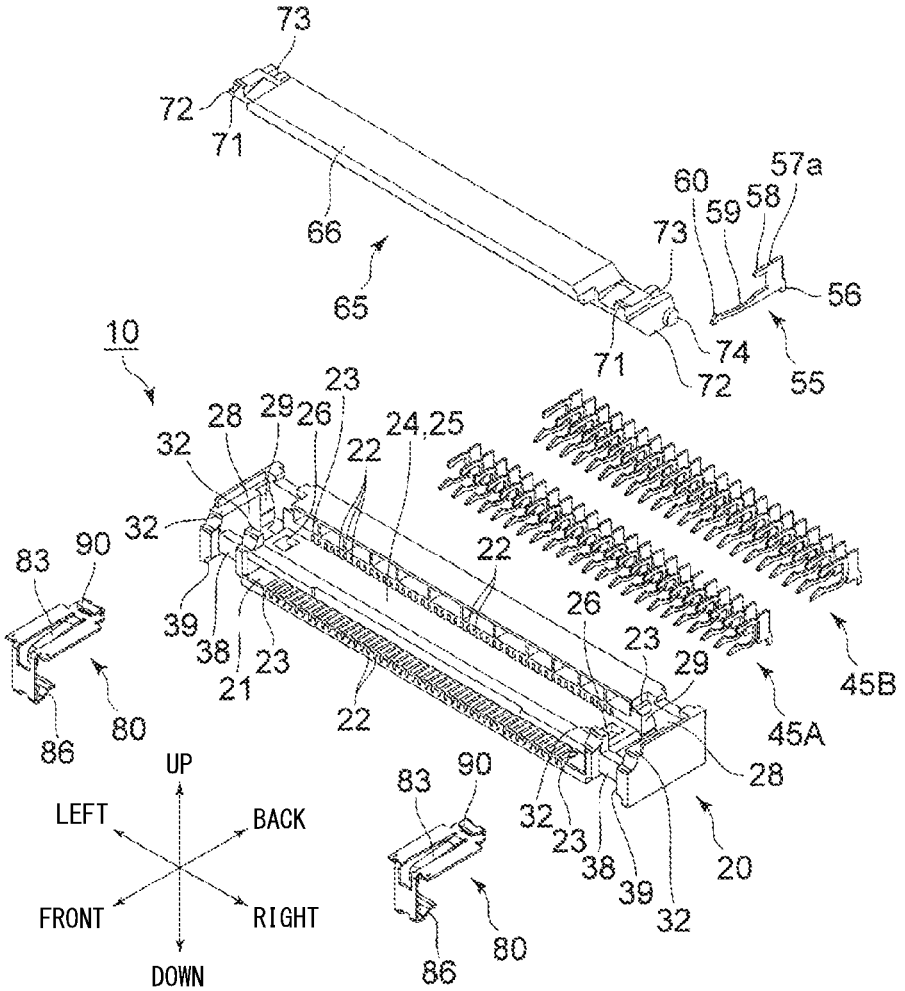
FIG. 3 is an exploded perspective view of the FPC connector as seen obliquely from front above.

As illustrated in FIGS. 1 and 2, when the end of the FPC 93 is brought closer to the FPC connector 10 from the front and inserted into the FPC insertion groove 21 of the insulator 20, the contact projection 60 of each ground contact 55 comes into contact with the ground terminal 99. In the case where the FPC 93 and/or electrical equipment (not illustrated) connected to the end of the FPC 93 opposite to the FPC connector 10 is electrostatically charged, the static electricity flows from the ground terminal 99 to the ground pattern of the circuit board CB via the ground contact 55.

When the FPC 93 is further inserted, the back end surface of each of the right and left locked portions 98 of the FPC 93 (end reinforcement member 96) comes into contact with the pressed surface 69 of the lock claw 68.

Figure 21:
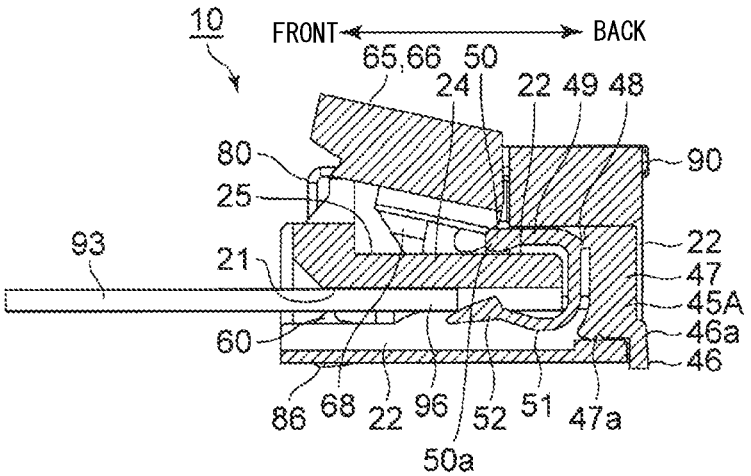
FIG. 21 is the same sectional view as in FIG. 10 when the lock member is located at the unlock position.
Figure 22:
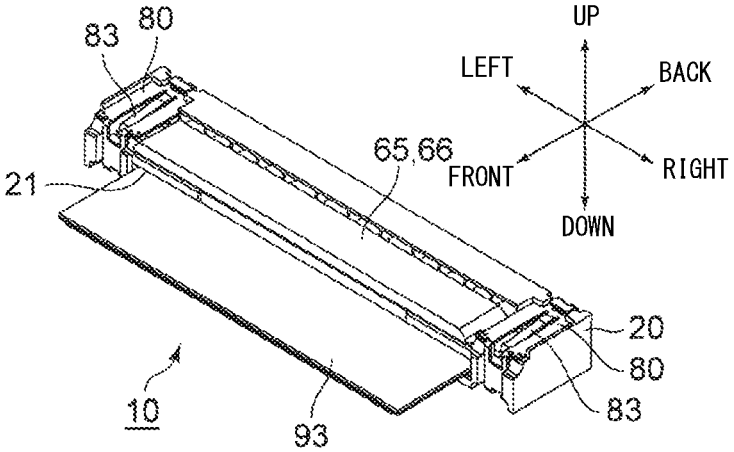
FIG. 22 is a perspective view of the FPC inserted in the insulator and the FPC connector with the lock member returned to the lock position, as seen obliquely from front above.
Figure 23:
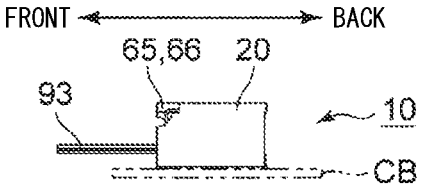
FIG. 23 is a side view of the FPC inserted in the insulator and the FPC connector with the lock member returned to the lock position.
Figure 24:
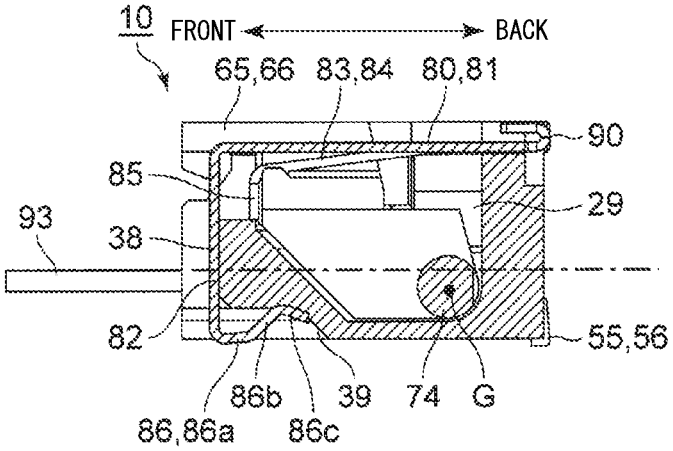
FIG. 24 is the same sectional view as in FIG. 8 when the lock member is returned to the lock position.

When the FPC 93 is moved further backward, the back end of the end reinforcement member 96 presses the elastic deformation piece 51 of each of the signal contacts 45A and 45B downward as illustrated in FIG. 21 (as a result of which the up-down gap formed between the contact projection 52 and the lower surface of the front ceiling wall 24 increases). Hence, while elastically deforming the connection portion 48, the entire sandwiching portion 49 rotates downward, and the abutting projection 50*a* of the stabilizer 50 abuts on the upper surface of the front ceiling wall 24.

When the FPC 93 is moved further backward, the FPC 93 enters the rear (back) of the FPC insertion groove 21 while elastically deforming the elastic deformation piece 51 downward (while further increasing the up-down gap formed between the contact projection 52 and the lower surface of the front ceiling wall 24).

Moreover, the right and left locked portions 98 of the end reinforcement member 96 press the pressed surfaces 69 of the right and left lock claws 68 of the lock member 65, so that the lock member 65 rotates to the unlock position while elastically deforming the cut and raised piece 83 of each lock member bias spring 80 upward.

When the FPC 93 is moved further backward, the end reinforcement member 96 enters the rear end (back end) of the FPC insertion groove 21, as illustrated in FIGS. 22 to 26. Further, when the back end of the end reinforcement member 96 climbs over the right and left lock claws 68 and the right and left engaging recesses 97 and the right and left lock claws 68 face each other in the up-down direction, the cut and raised piece 83 of each lock member bias spring 80 elastically returns to a free state and the lock member 65 rotates to return to the lock position, as a result of which the right and left lock claws 68 each enter the corresponding engaging recess 97 and the lock claw 68 faces the locked portion 98 from the front (from the escape direction of the FPC 93 from the insulator 20) (see FIG. 25). Here, the worker can feel strong clicking, and so make sure from the feeling in his or her hand that the lock member 65 has returned to the lock position, that is, the FPC 93 has been properly connected to the FPC connector 10. Accordingly, even in the case where it is difficult for the worker to visually check the FPC connector 10 as, for example, when the FPC connector 10 is fixed to the rear side in the office automation equipment, the worker can make sure that the FPC 93 is connected to the FPC connector 10.

Since each circuit pattern 94 of the FPC 93 is in contact with the contact projection 52 of a corresponding one of the signal contacts 45A and 45B, the FPC 93 and the circuit board CB electrically conduct through the signal contacts 45A and 45B.

Thus, by one operation of inserting the FPC 93 into the insulator 20, the FPC 93 can be reliably connected to the signal contacts 45A and 45B and the ground contacts 55. In addition, since the FPC 93 is inserted into the rear of the FPC insertion groove 21 while increasing the up-down gap formed between the contact projection 52 and the lower surface of the front ceiling wall 24 as mentioned above, the FPC 93 can be inserted into the rear of the FPC insertion groove 21 with a small insertion force.

If an unintentional (excessive) frontward external force is exerted on the FPC 93 after the lock member 65 rotates to return to the lock position, the lock surface 70 of each lock claw 68 abuts on (engages with) the front surface of the locked portion 98 (the back surface of the engaging recess 97). The lock claw 68 thus suppresses the frontward movement of the FPC 93.

Here, since the upper end of the front surface of each of the right and left locked portion 98 (the back surface of the engaging recess 97) of the FPC 93 abuts on (engages with) the upper end of the lock surface 70 of the lock claw 68 (the lower part of the locked portion 98 does not abut on the lock surface 70), the rotation center G of the rotation shaft 74 is located on the side (downward) opposite to the upward direction (the movement direction of the lock claw 68 from the lock position to the unlock position), with respect to (as compared with) the contact portion (of the upper end of the lock surface 70) of the lock claw 68 with the locked portion 98. Therefore, if a frontward force is exerted on the upper end of the lock surface 70 of each lock claw 68 from the upper end of the locked portion 98, a rotational moment of biasing the lock member 65 to rotate to the side opposite to the unlock position about the rotation center G of the rotation shaft 74 acts on the lock member 65.

This effectively prevents the FPC 93 from being unintentionally removed from the FPC connector 10 frontward.

Furthermore, when each circuit pattern 94 of the FPC 93 comes into contact with the contact projection 52 of a corresponding one of the signal contacts 45A and 45B, only the abutting projection 50*a* of the stabilizer 50 abuts on the upper surface of the front ceiling wall 24, so that not only the elastic deformation piece 51 but also the stabilizer 50 deforms elastically. Accordingly, the stress exerted on each of the signal contacts 45A and 45B by the insertion of the FPC 93 can be efficiently distributed by the elastic deformation piece 51 and the stabilizer 50 (and further the connection portion 48). Here, since the sandwiching portion 49 rotates while elastically deforming the connection portion 48, the elastic deformation piece 51 (contact projection 52) follows the circuit pattern 94 of the FPC 93 favorably.

Therefore, even in the case where the aforementioned excessive force acts on the FPC 93 or a turning force generated when the FPC 93 bends in the up-down direction near the FPC connector 10 acts on the FPC 93, the circuit patterns 94 of the FPC 93 and the signal contacts 45A and 45B can maintain a stable contact state.

To remove the FPC 93 from the FPC connector 10 in a lock state, for example, the worker manually rotates the lock member 65 to the unlock position (i.e. rotates each lock claw 68 to such a position where the lock claw 68 does not face the locked portion 98 from the front), thus withdrawing the lock claw 68 of the lock member 65 upward from the engaging recess 97 (locked portion 98) of the FPC 93. By manually pulling the FPC 93 frontward in this state as an example, the FPC 93 can be smoothly removed frontward from the FPC insertion groove 21 of the FPC connector 10.

The FPC connector 10 may be used in a mode illustrated in each of FIGS. 27 to 30.

The FPC connector 10 in FIGS. 27 to 30 is used as a straight (ST) type connector where the cable (FPC 93) is removably insertable in the direction orthogonal to the circuit board CB.

To mount such an FPC connector 10 on the circuit board CB, the tail piece 46 of each of the signal contacts 45A and 45B is soldered to the circuit pattern formed on the upper surface of the circuit board CB, and the tail piece 56 of each ground contact 55 and the second tail 90 of each lock member bias spring 80 are soldered to the ground pattern on the circuit board CB.

Figure 28:
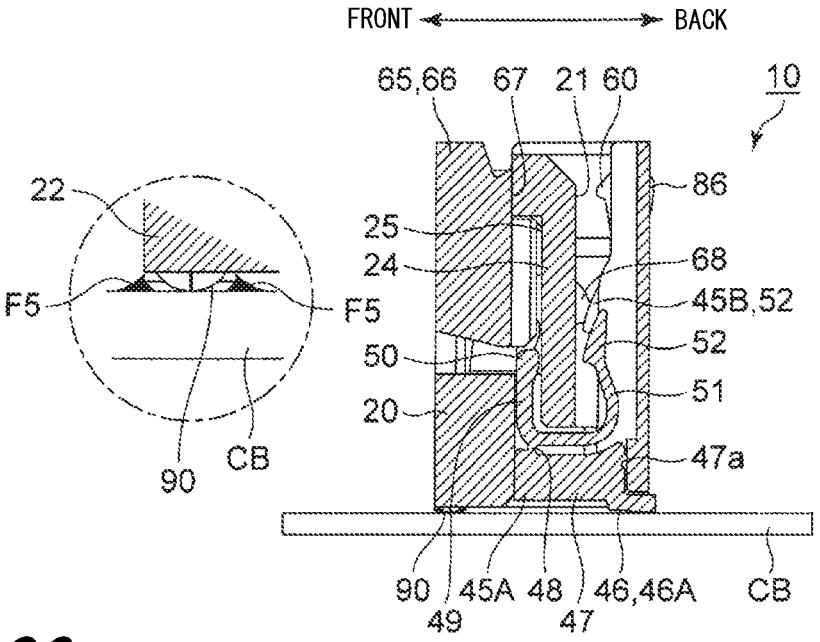
FIG. 28 is the same sectional view as in FIG. 10 and its partially enlarged view.

In this case, as illustrated in FIG. 28, it is preferable to form a solder fillet F5 between each of the front and back surfaces of the second tail 90 and the ground pattern while filling the solder slit 91 with solder.

Figure 29:
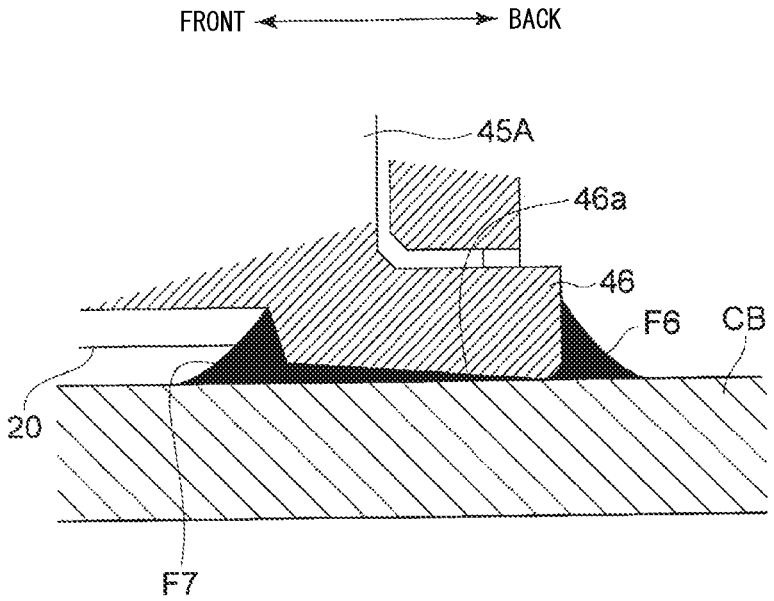
FIG. 29 is an enlarged view of a tail piece of a signal contact and a soldered portion of a circuit board.

Moreover, as illustrated in FIG. 29, it is preferable to form a solder fillet F6 between the back surface of the tail piece 46 of each of the signal contacts 45A and 45B and the circuit pattern of the circuit board CB. It is also preferable to form a solder fillet F7 between the tail piece 46 and the circuit pattern while filling, with solder, the space between the inclined end surface 46*a* and the upper surface (circuit pattern) of the circuit board CB which are separate from each other in the up-down direction. Each ground contact 55 is also preferably soldered to the ground pattern in the same mode as the signal contacts 45A and 45B.

In the case of using the FPC connector 10 as straight type, the FPC connector 10 is long in the up-down direction. Hence, for example in the case where the FPC 93 is subjected to a tension, a large rotational moment acts on the FPC connector 10 about the solder portion (the tail piece 46, 56, the second tail 90). However, by forming such solder fillets (especially the solder fillet F7), the possibility of the FPC connector 10 separating from the circuit board CB in the case where such a rotational moment is generated can be effectively eliminated.

Figure 30:
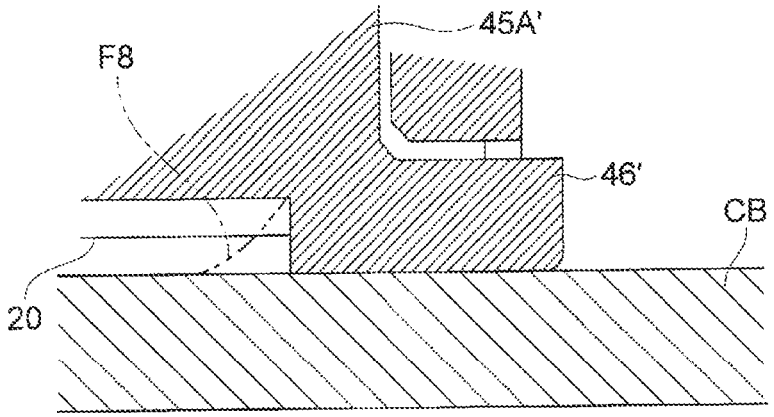
FIG. 30 is the same enlarged view as in FIG. 29 according to a comparative example.

Suppose the surface corresponding to the inclined end surface 46*a* of the tail piece 46 is parallel to the upper surface of the circuit board CB. In such a case, no solder enters the space between the surface of the tail piece 46 and the circuit board CB, and so the formed solder fillet F8 is smaller than the solder fillet F7, as illustrated in FIG. 30. The fixing force between the tail piece 46 and the circuit board CB by solder in such a case tends to be lower than that of this modification.

Thus, the signal contacts 45A and 45B, the ground contacts 55, and the lock member bias springs 80 in the disclosure can be mounted on the circuit board CB regardless of whether the FPC connector 10 is used as right angle (RA) type or straight (ST) type. This reduces the manufacturing cost of the FPC connector 10, as compared with the case where the signal contacts 45A and 45B, the ground contacts 55, and the lock member bias springs 80 of different specifications need to be prepared depending on the use mode of the FPC connector 10.

While the disclosed techniques have been described above by way of the embodiment, the disclosure is not limited to the foregoing embodiment, and various modifications are possible.

For example, if the central axis G of the rotation shaft 74 is located more on the first tail 86 (tail piece 46, 56) side than the ceiling surface 21*a* (the position of the long dashed short dashed line in each of FIGS. 9, 19, 20, 24, and 25) of the FPC insertion groove 21, the position of the central axis G may be changed.

The central axis G of the rotation shaft 74 may be, for example, closer to the ceiling surface 21*a* than in the foregoing embodiment. Such a design change incurs the possibility that the contact portion (of the lock surface 70) of the lock claw 68 of the lock member 65 located at the lock position with the locked portion 98 of the FPC 93 and the central axis G are located at the same position in the thickness direction of the FPC insertion groove 21 or the central axis G is located more on the ceiling surface 21*a* side than the contact portion. However, in the case where the contact portion and the central axis G are located at the same position in the thickness direction, a rotational moment (to the unlock position) is unlikely to act on the lock member 65 when the locked portion 98 comes into contact with the lock claw 68. In the case where the central axis G is located more on the ceiling surface 21*a* side than the contact portion, a rotational moment to the unlock position acts on the lock member 65, but this rotational moment is very small (because the central axis G is located more on the bottom surface side of the FPC insertion groove 21 than the ceiling surface 21*a* and the contact portion is located in the FPC insertion groove 21). Therefore, the possibility of the FPC 93 being unintentionally removed from the insulator 20 can be effectively eliminated in any of these cases.

To cause the rotational moment that acts on the lock member 65 about the rotation center G of the rotation shaft 74 when removing the FPC 93 frontward in a state where the lock member 65 is located at the lock position to "bias the lock member 65 to rotate to the side opposite to the unlock position", the rotation center G is ideally as close to the first tail 86 (tail piece 46, 56) as possible. When the rotation center G is located more on the first tail 86 (tail piece 46, 56) side than the bottom surface (the first tail 86 side surface) of the FPC insertion groove 21, a rotational moment of biasing the lock member 65 to rotate to the side opposite to the unlock position can be generated regardless of the thickness of the FPC 93, the shape of the lock member 65, and the like.

The sheet-like connection object may be a cable other than an FPC, such as a flexible flat cable (FFC) or a rigid board.

Although unintentional removal of the FPC 93 is prevented by locating each lock claw 68 of the lock member 65 in the engaging recess 97 of the FPC 93 which is a recess with an open side edge, a lock portion insertion portion which is a through hole or recess separated from the side edge of the FPC 93 toward the center of the FPC 93 in the width direction may be formed in one surface of the FPC 93 so that the lock claw 68 engages with this lock portion insertion portion (in this case, the part adjacent to the through hole or recess of the FPC 93 is the locked portion).

A projection member (lock member) may be formed in the lock member 65 as a separate member from the lock claw 68 (lock member) so that, by pressing the projection member with the cable, the lock member 65 located at the lock position is rotated to the unlock position. A lock portion may be formed by a member having a different structure from the lock claw 68.

When the lock member 65 rotates to the unlock position, the back end of the operation portion 66 of the lock member 65 may be caused to abut on the front end of the back part (the part located more backward than the operation portion receiving recess 25) of the insulator 20, to regulate the rotation of the lock member 65 over the unlock position to the side opposite to the lock position.

The ground contacts 55 may be omitted. The signal contacts may be contacts of one type.

Figure 31:
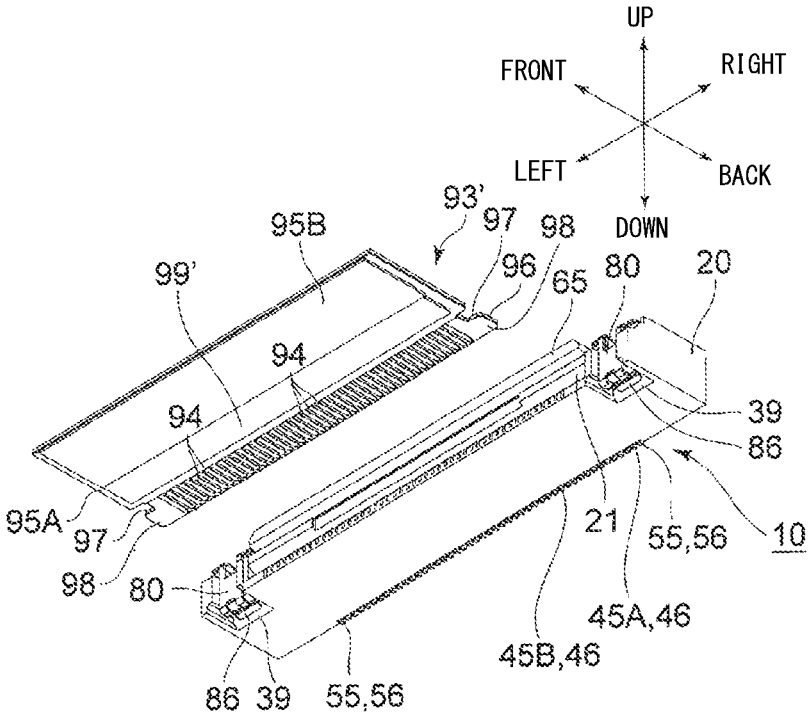
FIG. 31 is the same view as in FIG. 2 according to a modification.

An FPC illustrated in FIG. 31 may be used. An FPC 93' includes: an insulating cover layer 95A covering both surfaces of the part of the circuit patterns 94 other than both ends; a ground terminal 99' covering substantially the entire lower surface of the lower insulating cover layer 95A; and an insulating cover layer 95B covering the lower surface of the part of the ground terminal 99' other than the front and back ends. When the FPC 93' is inserted into the FPC connector 10, each circuit pattern 94 of the FPC 93' comes into contact with the contact projection 52 of a corresponding one of the signal contacts 45A and 45B, and the ground terminal 99' comes into contact with the contact projection 60 of each ground contact 55.

INDUSTRIAL APPLICABILITY

The connector according to the disclosure can be widely used as a connector for connecting a sheet-like connection object such as a flexible flat cable (FFC), a flexible printed circuit board (FPC), or a rigid board.

REFERENCE SIGNS LIST

10 FPC connector (cable connector)
20 insulator
21 FPC insertion groove (cable insertion groove)
21*a* ceiling surface (reference surface)
22 signal contact insertion groove
23 ground contact insertion groove
24 front ceiling wall
25 operation portion receiving recess
26 lock claw receiving hole
28 supported portion receiving recess
29 inclined guide surface
30 rotation shaft support recess
32 base portion support surface
34 second tail support groove
35 stopper groove
36 passage allowance groove
38 orthogonal portion support groove
39 first tail support groove
45A, 45B signal contact (contact)
46 tail piece
46*a* inclined end surface
47 fixed piece
47*a* locking projection
48 connection portion
49 sandwiching portion
50 stabilizer
51 elastic deformation piece
52 contact projection
55 ground contact
56 tail piece
56*a* inclined end surface
57 fixed piece
57*a* locking projection
58 stabilizer
59 elastic deformation piece
60 contact projection
65 lock member
66 operation portion
67 lock position regulation surface

68 lock claw (lock portion)
69 pressed surface
70 lock surface
71 spring receiving projection
72 supported portion
73 slit
74 rotation shaft
80 lock member bias spring (bias portion)
81 base portion
82 orthogonal portion
83 cut and raised piece
84 lock member press portion
85 tip orthogonal portion
86 first tail
86*a* bottom portion
86*b* inclined portion
86*c* engaging projection
87 solder slit
89 fitting portion
90 second tail
91 solder slit
93, 93' FPC (flexible printed circuit board) (cable)
94 circuit pattern
95, 95A, 95B insulating cover layer
96 end reinforcement member
97 engaging recess (lock portion insertion portion)
98 locked portion
99, 99' ground terminal
CB circuit board
F1, F2, F3, F4, F5, F6, F7 solder fillet
G rotation center

The invention claimed is:

1. A cable connector comprising:

an insulator having a cable insertion groove into which a sheet-like cable having a locked portion is removably insertable;

a contact supported by the insulator and coming into contact with the cable inserted in the insulator;

a lock member rotatable about a rotation shaft thereof supported by the insulator, between a lock position where a lock portion of the lock member faces the locked portion inserted in the insulator from an escape direction of the cable from the insulator and an unlock position where the lock portion does not face the locked portion from the escape direction, the lock member further having a spring receiving projection projected from an outer surface of the lock member on the unlock position side; and a bias portion for biasing the lock member to the lock position, and allowing the lock member to rotate to the unlock position by elastic deformation, wherein an inner surface of the cable insertion groove includes a reference surface which is an end surface in a movement direction of the lock portion from the lock position to the unlock position, a rotation center of the rotation shaft is located on a side opposite to the movement direction, with respect to the reference surface, and the bias portion abuts on the spring receiving projection from the unlock position side and biases the lock member to the lock position.

2. The cable connector according to claim 1, wherein the rotation center of the rotation shaft is located on the side opposite to the movement direction of the lock portion from the lock position to the unlock position, with respect to a contact portion of the lock portion located at the lock position with the locked portion.

3. The cable connector according to claim 1, wherein the cable includes a lock portion insertion portion which is a recess or through hole that passes through the cable in a thickness direction and is adjacent to the locked portion, and the lock portion is a lock claw that, when the lock member is located at the lock position, enters the lock portion insertion portion and faces the locked portion from the escape direction.

4. The cable connector according to claim 1, wherein the contact includes:

a fixed piece attached to the insulator in a fixed state;

an elastic deformation piece coming into contact with the cable inserted in the insulator, and elastically deformable in a thickness direction of the cable; and a connection portion connecting a base end of the elastic deformation piece and the fixed piece, and enabling the elastic deformation piece to swing in the thickness direction about the base end relative to the fixed piece.

* * * * *